US009325137B2

(12) United States Patent
Wu et al.

(10) Patent No.: US 9,325,137 B2
(45) Date of Patent: Apr. 26, 2016

(54) PLUG CONNECTOR ASSEMBLY WITH FIRM STRUCTURE AND METHOD OF ASSEMBLING THE SAME

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/678,487

(22) Filed: Apr. 3, 2015

(65) Prior Publication Data

US 2015/0288096 A1 Oct. 8, 2015

(30) Foreign Application Priority Data

Apr. 4, 2014 (CN) ..... 2014 1 0134388

(51) Int. Cl.

| | |
|---|---|
| ***H01R 13/627*** | (2006.01) |
| ***H01R 43/24*** | (2006.01) |
| ***H01R 13/405*** | (2006.01) |
| ***H01R 13/58*** | (2006.01) |

(52) U.S. Cl.

CPC ..... *H01R 43/24* (2013.01); *H01R 13/405* (2013.01); *H01R 13/5845* (2013.01); *H01R 13/6271* (2013.01); *Y10T 29/49147* (2015.01); *Y10T 29/49176* (2015.01)

(58) Field of Classification Search

CPC .. H01R 43/24; H01R 13/5845; H01R 13/405; H01R 13/6271; H01R 24/60; H01R 24/62; Y10T 29/49147; Y10T 29/176

USPC ..... 439/357

See application file for complete search history.

(56) References Cited

U.S. PATENT DOCUMENTS 5,609,499 A * 3/1997 Tan ..... H01R 4/70 439/353

7,144,267 B1 12/2006 Huang et al.

(Continued)

*Primary Examiner* — Jean F Duverne

(74) *Attorney, Agent, or Firm* — Ming Chieh Chang; Wei Te Chung

(57) ABSTRACT

A plug connector assembly includes a mating member, a cable, an internal member, and a strain relief member. The mating member includes an insulative body, some terminals, a latch, and an insulative member. The latch includes a base portion, a latching arm extending from a respective side of the base portion, and a latching portion projecting from an end thereof The internal member has some recessing portions on an surface thereof The strain relief member has some projecting portions filling the recessing portions. A method of assembling the plug connector assembly comprises molding an internal member to enclose a respective part of the mating member and molding plural recessing portions on an outer surface of the internal member, and molding a strain relief member to enclose a respective part of the internal member and molding plural projecting portions on the strain relief member to fill the recessing portions.

1 Claim, 12 Drawing Sheets

(56) References Cited

U.S. PATENT DOCUMENTS

| | | | | |
|---|---|---|---|---|
| 7,534,141 | B1 * | 5/2009 | Wu | H01R 24/62 439/607.01 |
| 7,625,236 | B1 * | 12/2009 | Wu | H01R 24/62 439/607.58 |
| 8,303,342 | B2 * | 11/2012 | Shi | H01R 24/60 439/607.41 |
| 8,430,693 | B2 * | 4/2013 | Wu | H01R 13/6658 439/607.5 |
| 8,708,734 | B2 | 4/2014 | Su et al. | |
| 8,821,181 | B1 | 9/2014 | Lam et al. | |
| 8,870,598 | B2 | 10/2014 | Qi et al. | |
| 8,882,529 | B2 | 11/2014 | Weber et al. | |
| 2008/0044141 | A1 * | 2/2008 | Willis | G02B 6/3887 385/88 |
| 2011/0143577 | A1 * | 6/2011 | Su | H01R 13/5816 439/460 |
| 2011/0195593 | A1 * | 8/2011 | McGrath | H01R 12/594 439/345 |
| 2013/0189872 | A1 | 7/2013 | Siahaan et al. | |
| 2014/0073185 | A1 | 3/2014 | Siahaan et al. | |

* cited by examiner

PLUG CONNECTOR ASSEMBLY WITH FIRM STRUCTURE AND METHOD OF ASSEMBLING THE SAME

BACKGROUND OF THE INVENTION

1. Field of the Invention

The present invention relates to a plug connector assembly, and more particularly to a structure of anti-pullout of the cable and a method of assembling the same.

2. Description of Related Arts

U.S. Pat. No. 8,708,734, issued on Apr. 29, 2014, discloses a cable assembly including a housing, a plurality of terminals received in the housing, a printed circuit board assembled to the rear ends of the terminals, an inner molding enclosing the printed circuit board, a cable having a plurality of wires, a metal shell enclosing the housing, a strain relief portion molded over the inner molding, and a rear cover assembled on the metal shell. U.S. Patent Application Publication No. 2013/0189872, published on Jul. 25, 2013, discloses a cable assembly including an inner strain-relief portion and an outer strain-relief portion. The inner strain-relief portion includes one or more interlocks to provide adhesion between the inner strain-relief portion and the outer strain-relief portion. U.S. Pat. No. 8,882,529, issued on Nov. 11, 2014, discloses a receptacle connector including a retention latch having a pair of retaining spring arms that are adapted to engage with a retention feature of a corresponding connector tab.

An improved plug connector assembly is desired to offer advantages over the related art.

SUMMARY OF THE INVENTION

An object of the present invention is to provide a plug connector assembly, and more particularly to a plug connector assembly with high quality of anti-pullout of the cable.

To achieve the above-mentioned object, a plug connector assembly includes a mating member, a cable electrically connected to the mating member, an internal member molded outside of the mating member, and a strain relief member molded outside of the internal member. The mating member includes an insulative body, a plurality of terminals, a latch disposed between the terminals for latching with a mating connector, and an insulative member disposed behind the insulative body. The latch includes a base portion, a latching arm extending forwardly from a respective side of the base portion, and a latching portion projecting inwardly from a front end thereof The internal member has a plurality of recessing portions on an outer surface thereof The strain relief member has a plurality of projecting portions filling the recessing portions to increase a pulling force of the cable.

A method for manufacturing the plug connector assembly comprises the steps of: providing an insulative body; inserting a plurality of terminals into the insulative body; inserting a latch from an end of the insulative body, the latch comprising a base portion, a latching arm extending forwardly from a respective side of the base portion, and a latching portion projecting inwardly from a front end thereof; soldering a cable to the mating member to complete an electrical connection; molding an internal member to enclose a part of the mating member and a part of the cable and molding a plurality of recessing portions on an outer surface of the internal member; and molding a strain relief member to enclose a part of the internal member and a part of the cable and molding a plurality of projecting portions on the strain relief member to fill the recessing portions.

DETAILED DESCRIPTION OF THE PREFERRED EMBODIMENT

Reference will now be made in detail to some preferred embodiments of the present invention.

Figure 1:
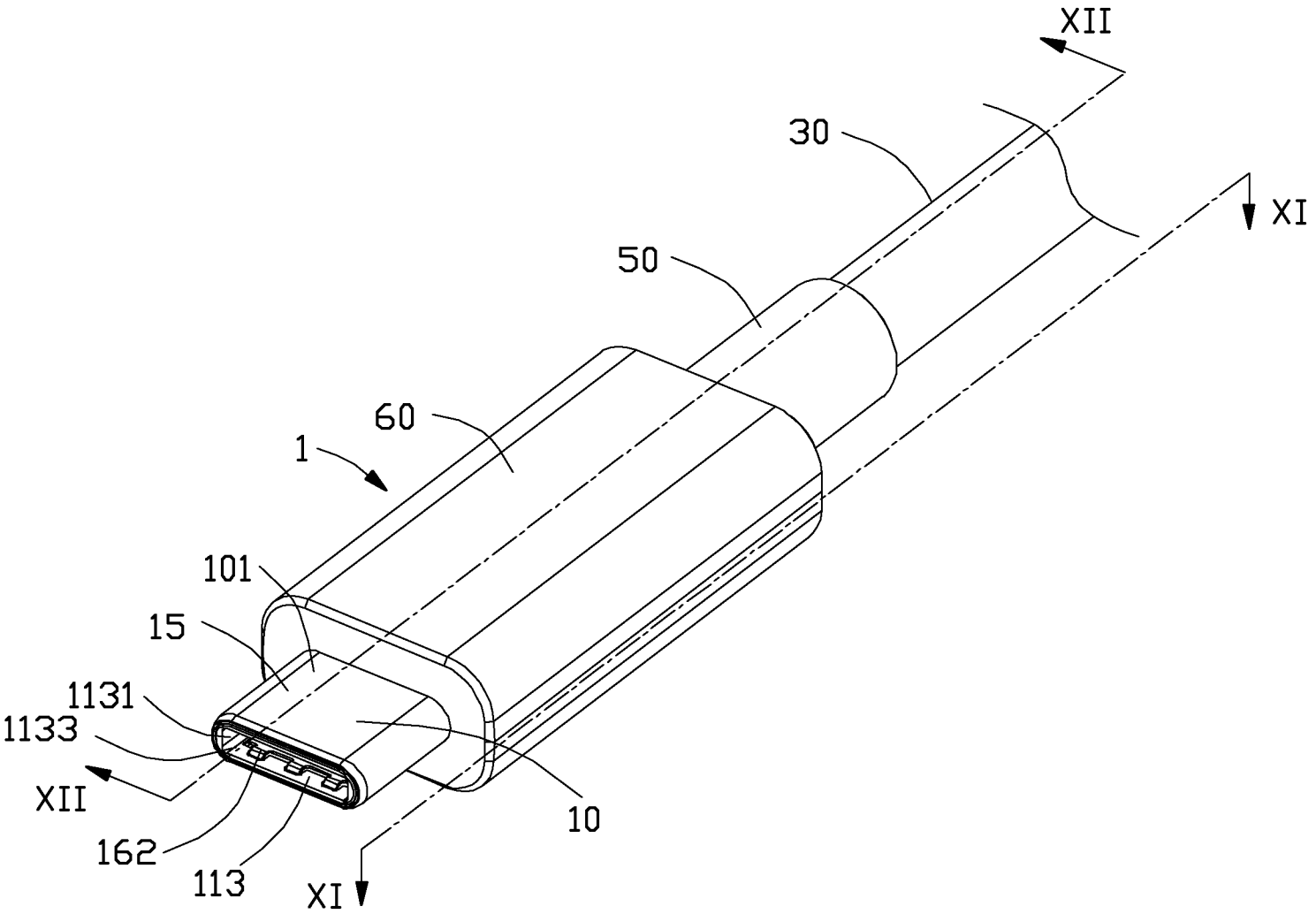
FIG. 1 is a perspective view of a plug connector assembly in accordance with the present invention.
Figure 2:
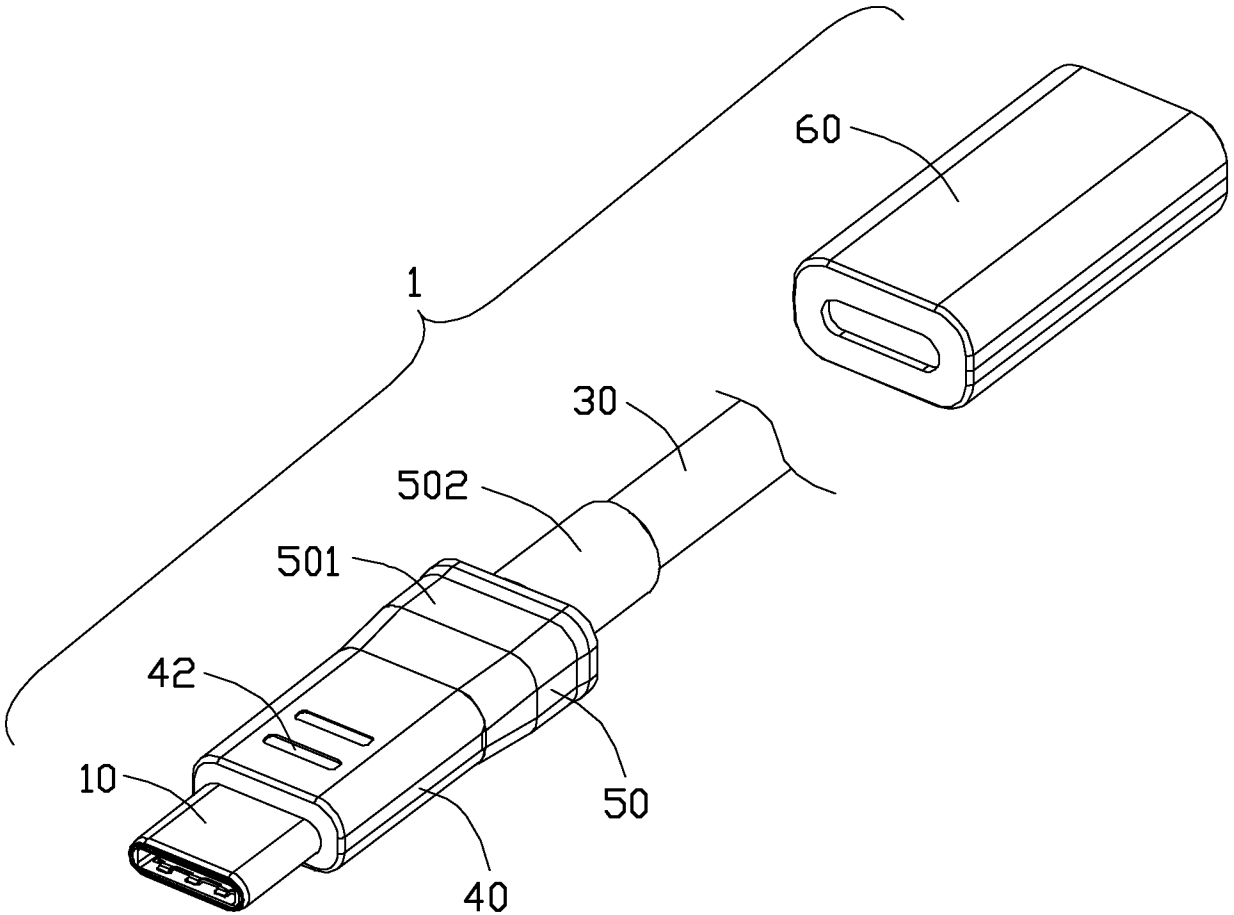
FIG. 2 is a partly exploded view of the plug connector assembly as shown in FIG. 1.
Figure 3:
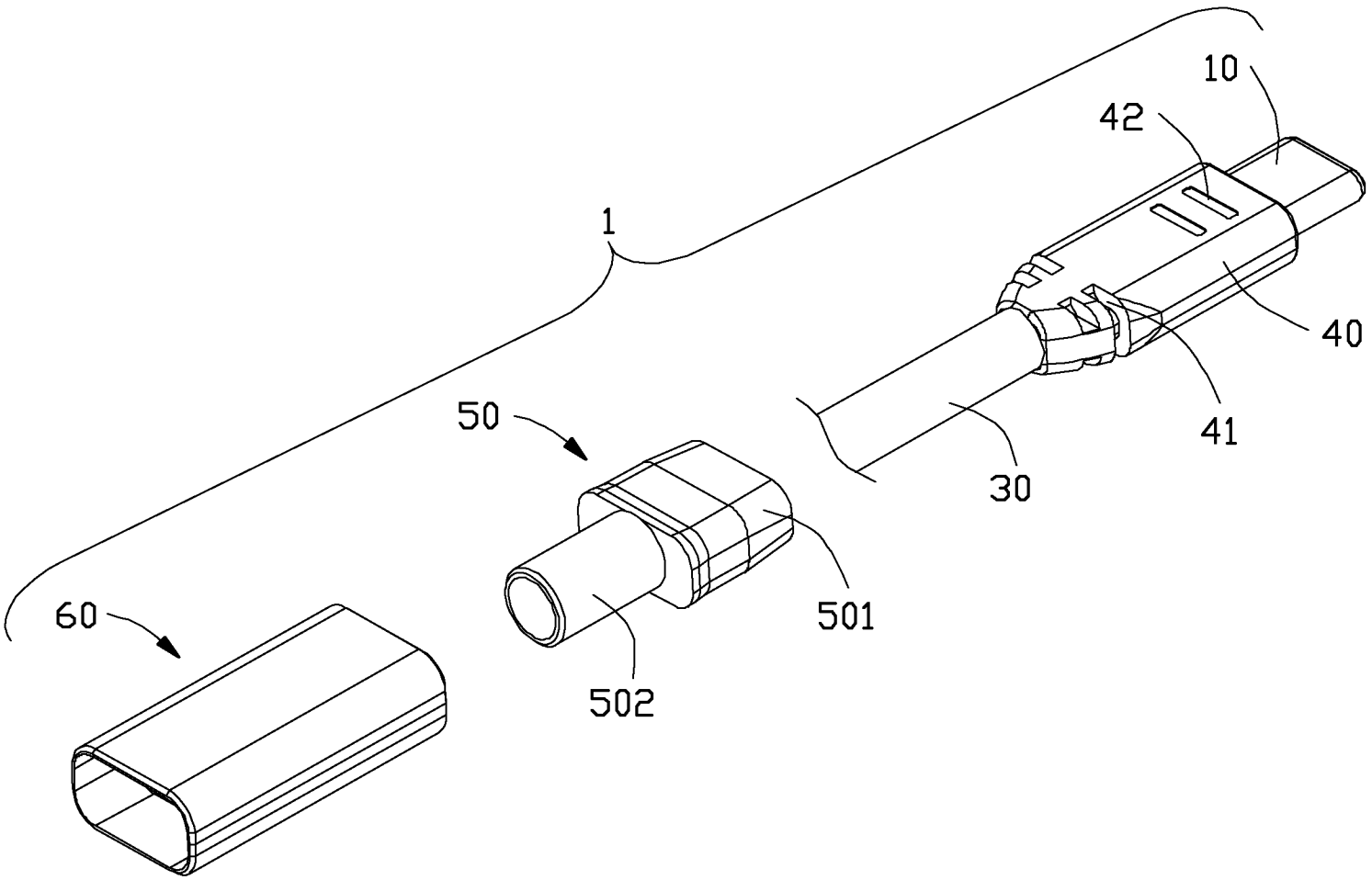
FIG. 3 is a further partly exploded view of the plug connector assembly as shown in FIG. 2.
Figure 4:
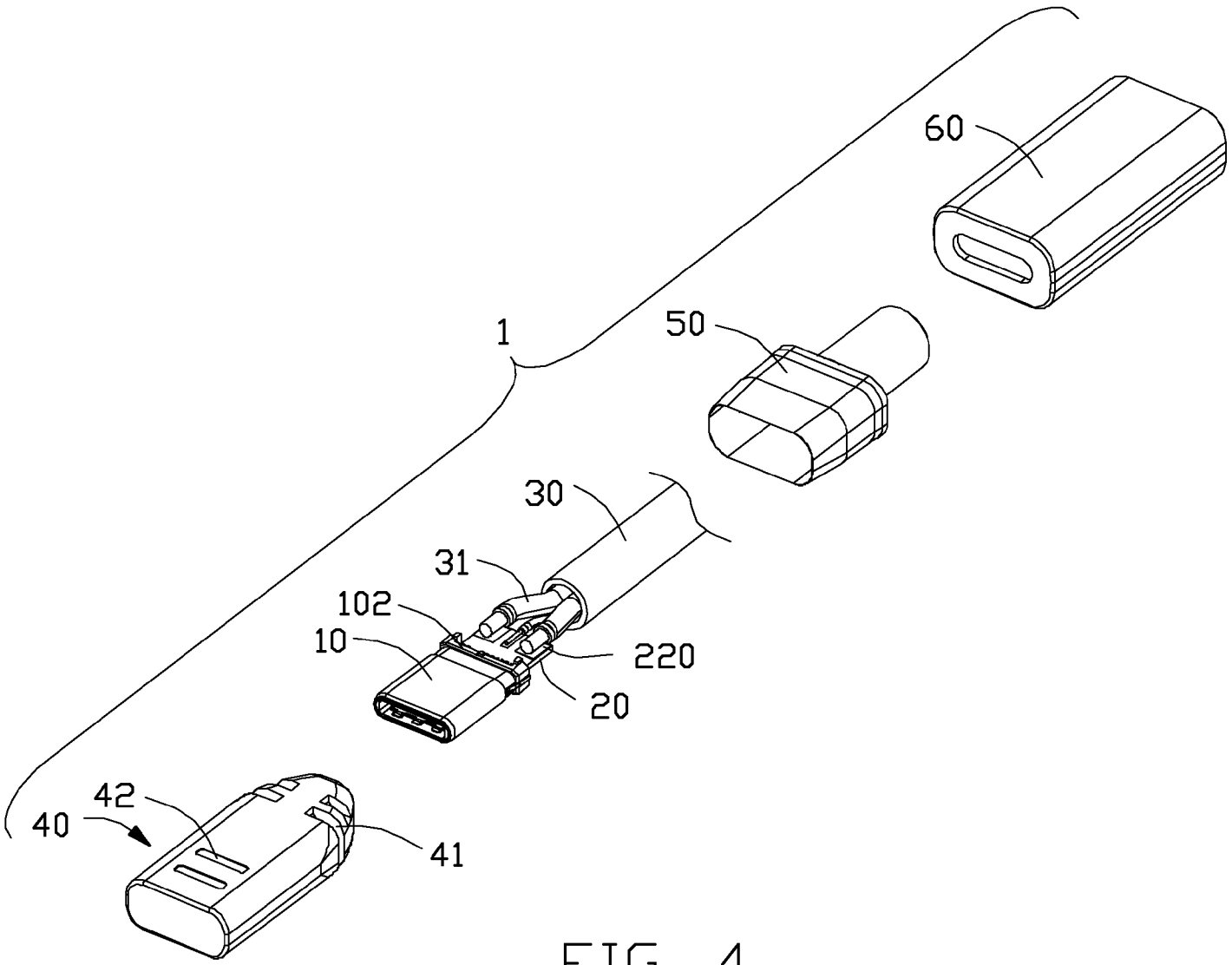
FIG. 4 is another further partly exploded view of the plug connector assembly as shown in FIG. 3.
Figure 5:
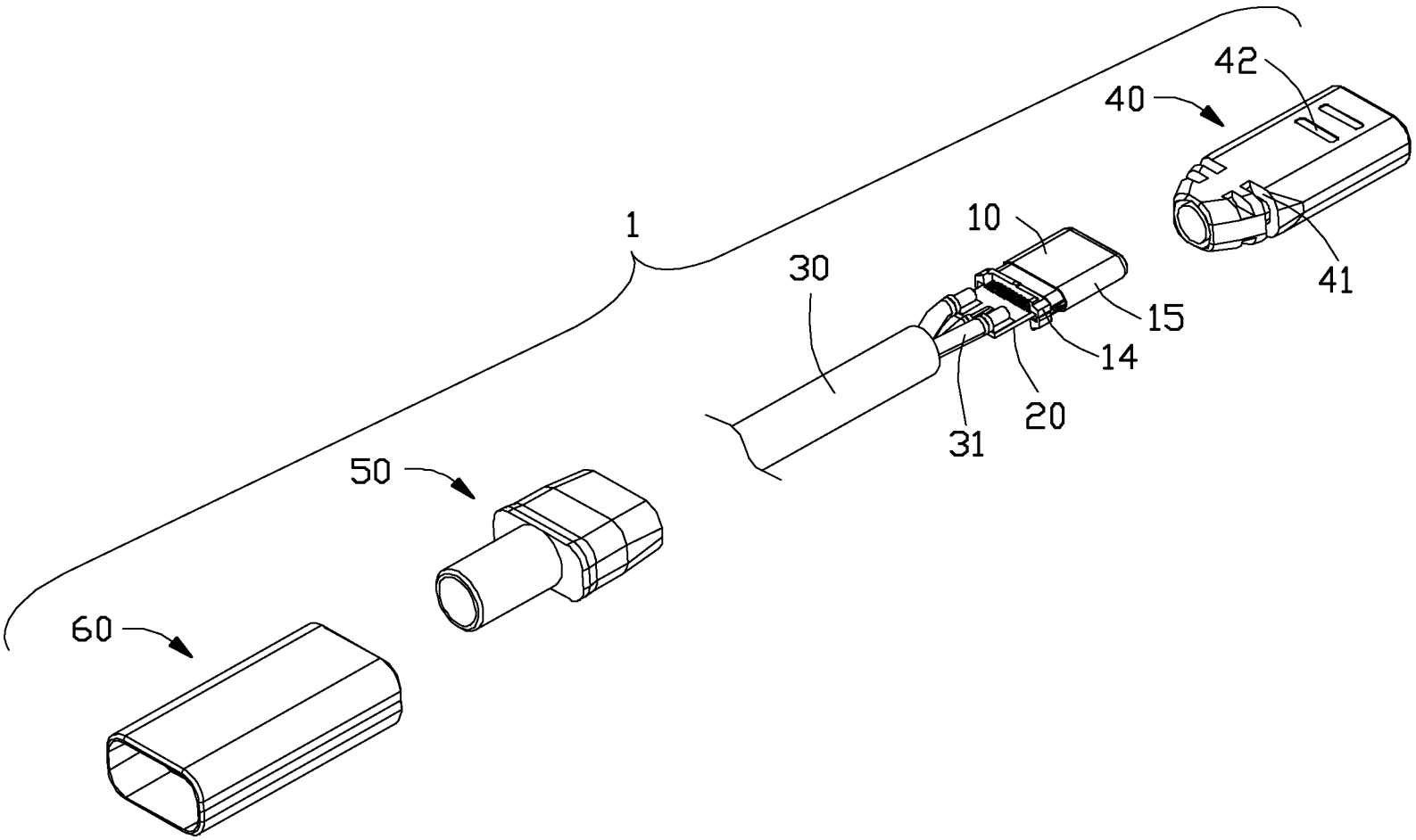
FIG. 5 is another partly exploded view of the plug connector assembly as shown in FIG. 4.
Figure 6:
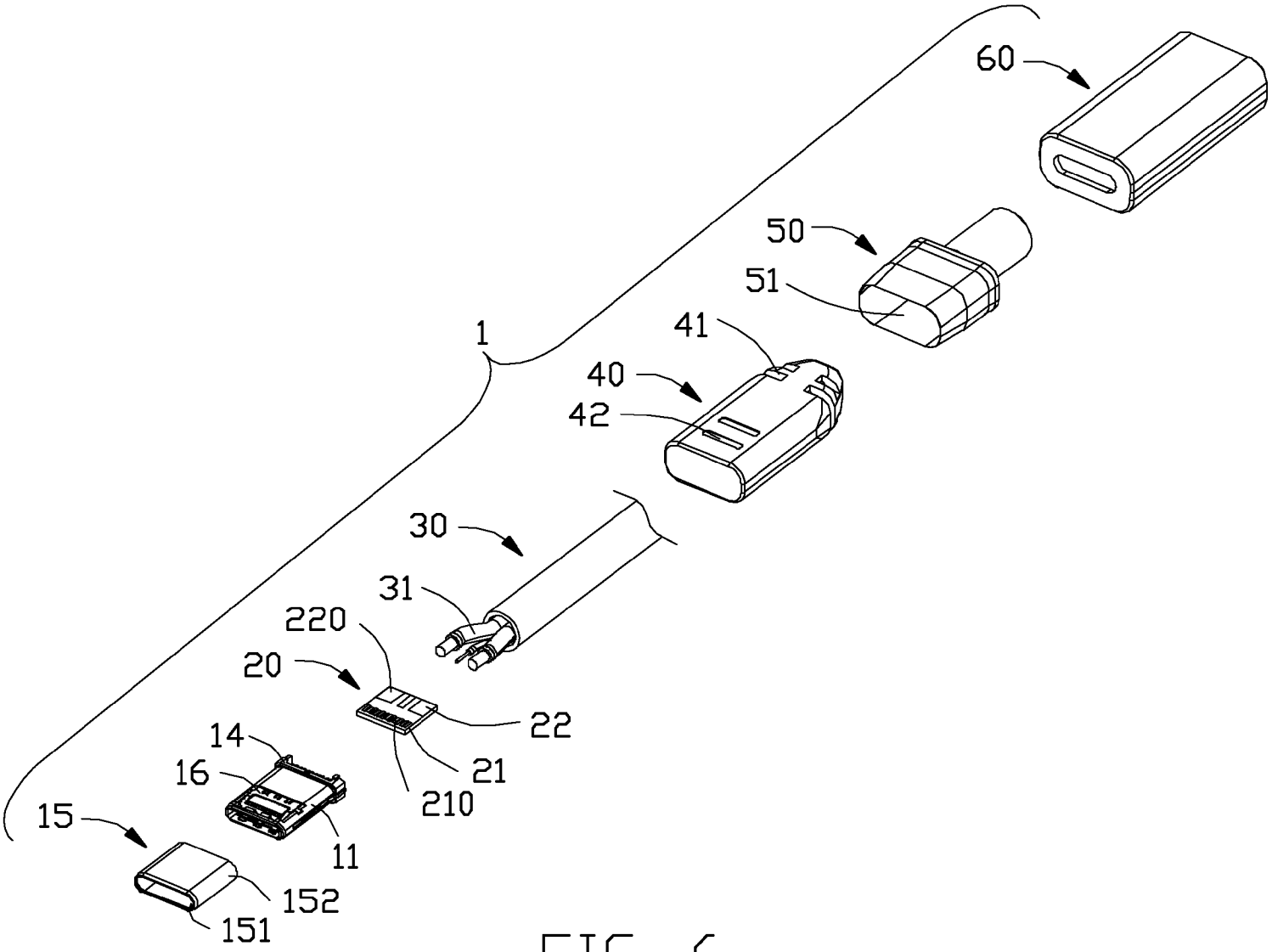
FIG. 6 is an exploded view of the plug connector assembly as shown in FIG. 1.
Figure 7:
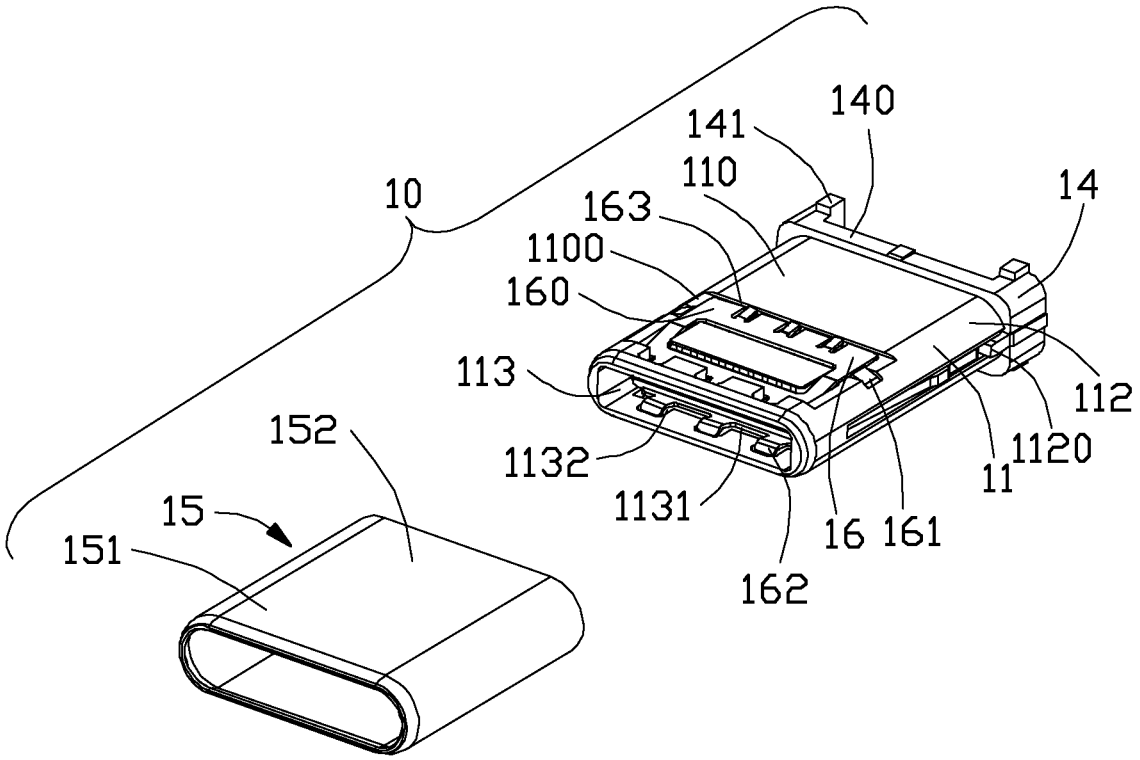
FIG. 7 is a partly exploded view of the mating member of the plug connector assembly as shown in FIG. 1.
Figure 8:
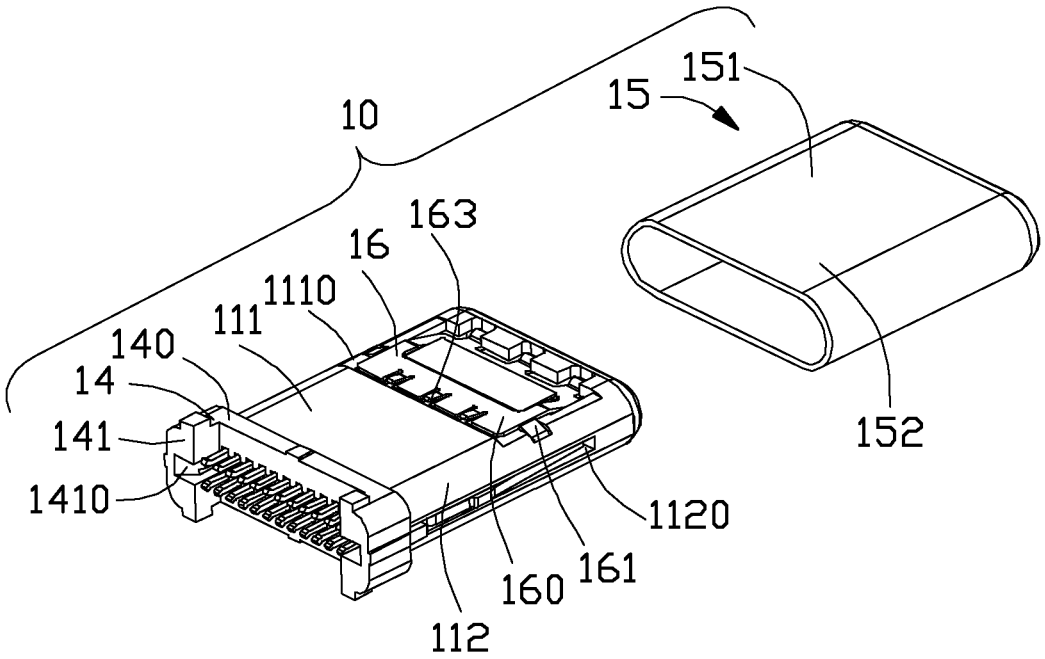
FIG. 8 is another partly exploded view of the mating member of the plug connector assembly as shown in FIG. 7.
Figure 9:
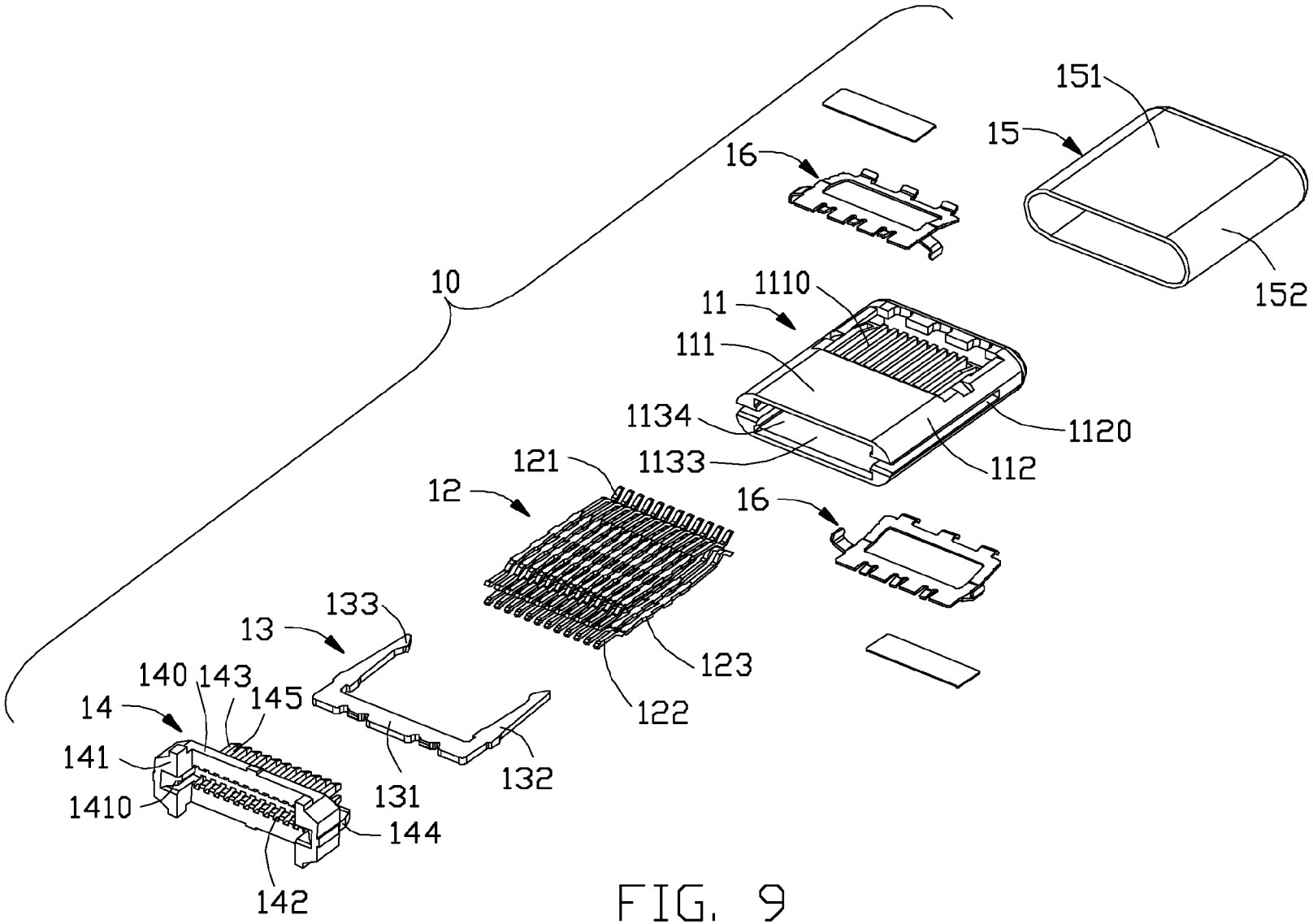
FIG. 9 is an exploded view of the mating member of the plug connector assembly as shown in FIG. 1.
Figure 10:
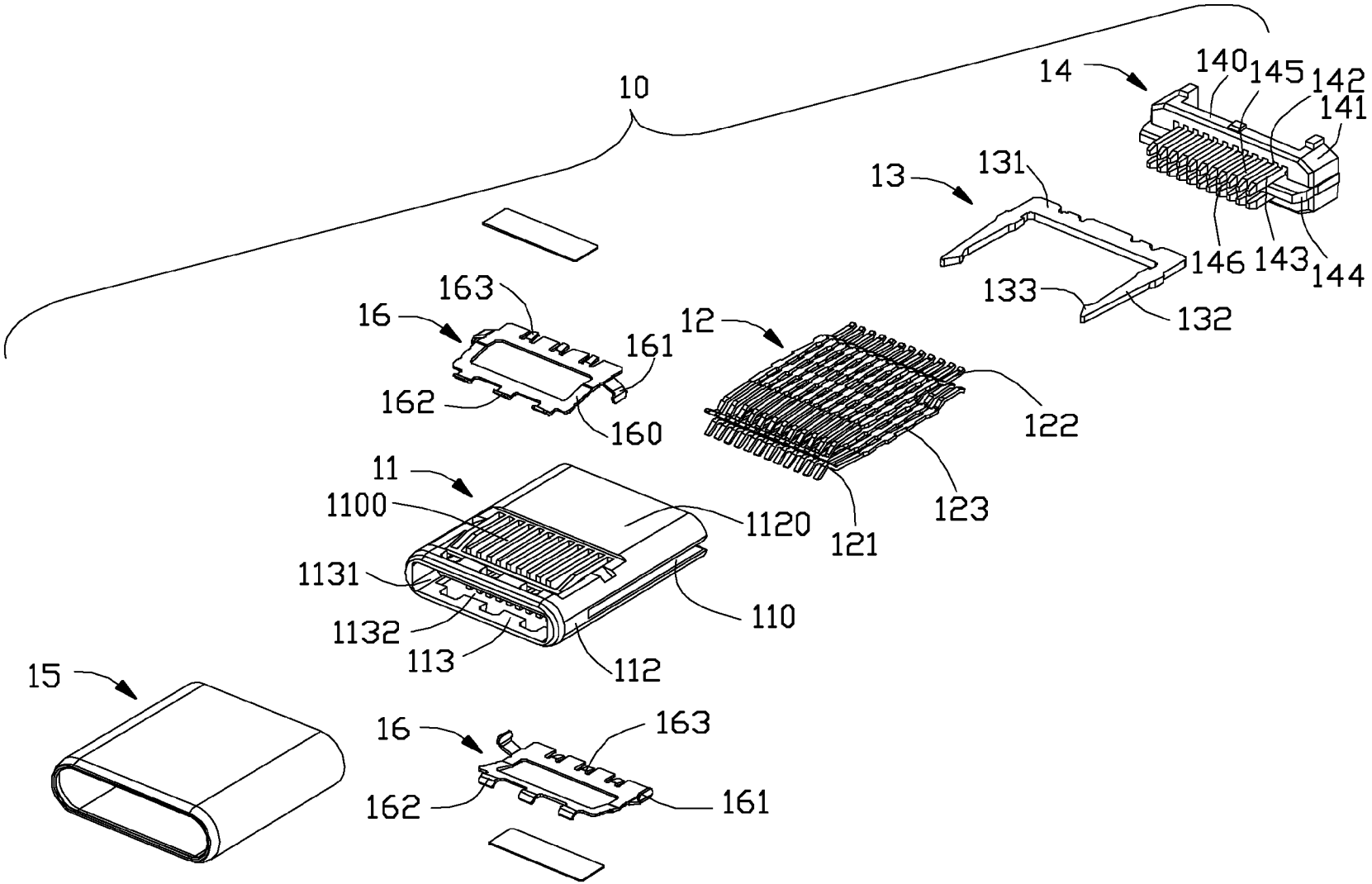
FIG. 10 is another exploded view of the mating member of the plug connector assembly as shown in FIG. 9.
Figure 11:
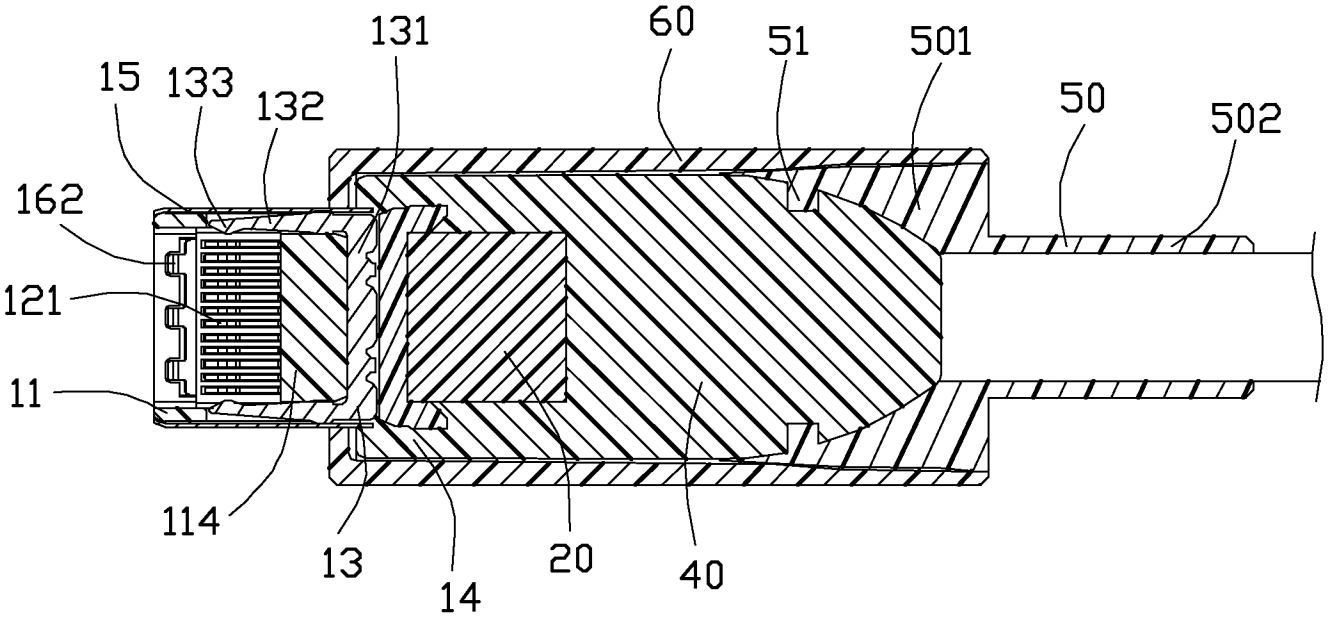
FIG. 11 is a cross-sectional view of the plug connector assembly taken along line 11-11 of FIG. 1.
Figure 12:
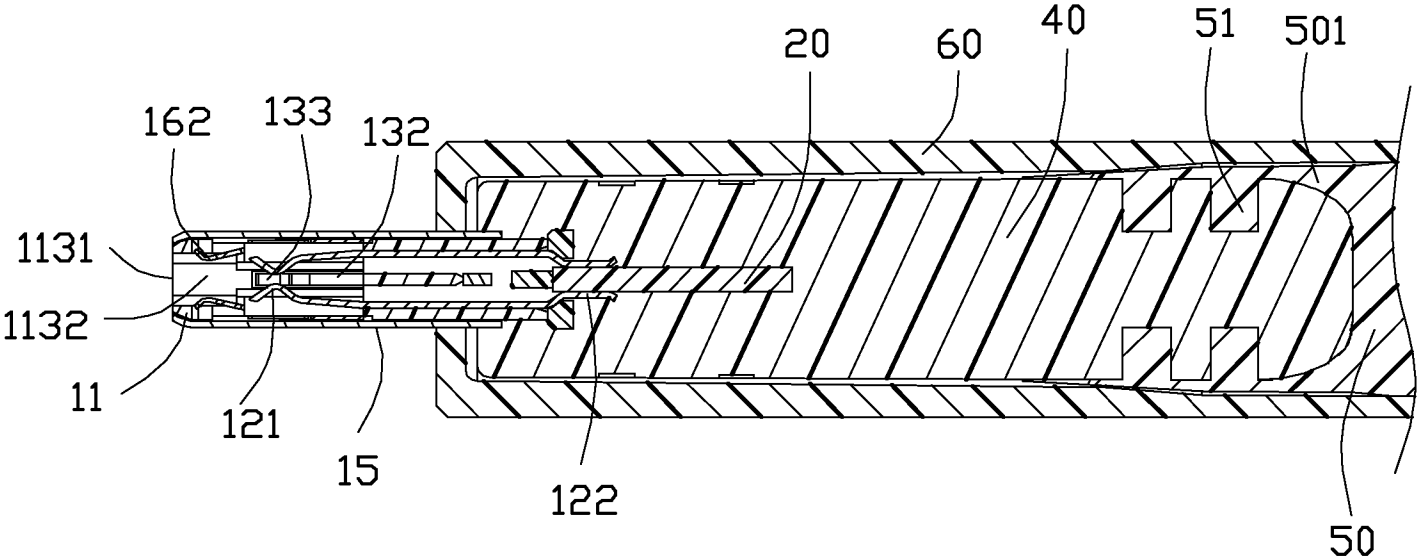
FIG. 12 is a cross-sectional view of the plug connector assembly taken along line 12-12 of FIG. 1.

Referring to FIGS. 1 to 12, a plug connector assembly 1 for mating with a mating connector (not shown) in this invention comprises a mating member 10, an adapter board 20 disposed behind and electrically connected to the mating member 10, a cable 30 defining a plurality of core wires 31 and electrically connected to the adapter board 20, an internal member 40 molded outside of the mating member 10 and the cable 30, a strain relief member 50 molded outside of the internal member 40 and the cable 30, and an outer housing 60 disposed outside. The plug connector assembly 1 can be inserted into the mating connector in two different directions.

The mating member 10 comprises a mating front end 101 inserted into the mating connector and a mating rear end 102 disposed behind the mating front end 101. The mating member 10 includes an insulative body 11, a plurality of terminals 12 mounted in the insulative body 11 and spaced in two rows in up and down, a latch 13 disposed between two rows of the terminals 12 for latching with the mating connector, an insulative member 14 disposed behind the insulative body 11, a metal shell 15 disposed out of the insulative body 11 and the insulative member 14, and a grounding member 16 disposed on the insulative body 11 and electrically connected to the metal shell 15.

Referring to FIGS. 7 to 12, the insulative body 11 comprises a top wall 110, a bottom wall 111 spaced parallel to the top wall 110, and a pair of side walls 112 spaced parallel and connecting the top wall 110 and the bottom wall 111. The top wall 110, the bottom wall 111 and the side walls 112 cooperating form a receiving space 113. The insulative body 11 further comprises a spacing wall 114. The spacing wall 114 separates the receiving space 113 to form a front portion 1132 having a front opening 1131 and a rear portion 1134 having a rear opening 1133. The front of the top wall 110 includes a plurality of upper slots 1100 communicating with the front portion 1132 of the receiving space 113. And the front of the bottom wall 111 includes a plurality of lower slots 1110 communicating with the front portion 1132 of the receiving space 113 too. Each side wall 112 includes a slot 1120 extending forwardly from a rear end of the insulative body 11. The slots 1120 are not communicated with a front end of the insulative body 11. The slots 1120 are communicated with the front portion 1132 and the rear portion 1134 of the receiving space 113, respectively.

Referring to FIGS. 7 to 12, each terminal 12 comprises a front mating portion 121 extending into the front portion 113 of the receiving space 113, a rear mating portion 122 extending rearwardly, and a holding portion 123 between the front mating portion 121 and the rear mating portion 122 and held in the insulative body 11. The front mating portion 121 is used for electrically connecting with the mating connector. The rear mating portion 122 is used for electrically connecting with the adapter board 20. The front portion 121 of the upper row terminals 12 is face to face with the front portion 121 of the lower row terminals 12.

Referring to FIGS. 9 to 12, the latch 13 comprises a base portion 131 extending along a left-to-right direction, a latching arm 132 extending forwardly from a respective side of the base portion 131, and a latching portion 133 projecting inwardly from the front end of two latching arms 132. The latch 13 is assembled into the insulative body 11 along a back-to-front direction through the rear opening 1133 of the rear portion 1134 of the receiving space 113. The base portion 113 holds forwardly against the spacing wall 114 of the insulative body 11. The pair of latching arms 132 are received in the slots 1120 respectively. At least a part of the latching portion 133 is extended into the front portion 1132 of the receiving space 113. The pair of latching portions 133 are disposed face to face in left-to-right direction.

Referring to FIGS. 9 to 12, the insulative member 14 and the insulative body 11 cooperate to fix the latch 13. The insulative member 14 comprises an insulative base 140, an extending portion 141 extending rearwardly from two sides of the insulative base 140 respectively, two rows of through holes 142 arranged spaced in up and down and going through the insulative base 140 in front-to-back direction, two rows of convex posts 143 arranged spaced in up and down and extending forwardly from the insulative base 140, and a projecting portion 144 extending forwardly from the insulative base 140 and disposed between two rows of the convex posts 143. A channel 145 is formed between the adjacent convex posts 143 and communicated with the corresponding through hole 142. Each extending portion 141 comprises a mounting groove 1410 extending along the front-to-back direction. A forwardly extending distance of two rows of the convex posts 143 is longer than the forwardly extending distance of the projecting portion 144. A receiving groove 146 is formed between two rows of the convex posts 143. A size of the insulative base 140 in up and down is larger than the size of the insulative body 11 in up and down. So that, after the insulative member 14 being mounted to the insulative body 11, the insulative base 140 projects outwardly relatively to the top wall 110 and the bottom wall 111 of the insulative body 11. After the insulative member 14 being mounted to the insulative body 11 from back to front, the base portion 131 is received in the receiving groove 146. The projecting portion 144 is holding against the end of the base portion 131. The rear mating portion 122 of each terminal 12 goes through the insulative base 140 through the corresponding channel 145 and the through hole 142.

Referring to FIGS. 1 to 12, the metal shell 15 has a structure with periphery closed to guarantee the performance of sealing and anti-EMI. The closed structure of the metal shell 15 can be formed by the methods of metal sheet pumping process, metal strip bending process, or metal material casting process. The metal shell 15 comprises a front end 151 and a rear end 152 disposed relatively to the front end 151.

Referring to FIGS. 9 to 12, the number of the grounding member 16 is two. Each grounding member 16 is received in the upper slot 1100 and the lower slot 1110, respectively. The grounding member 16 comprises a tabulate grounding main portion 160, a mounting portion 161 extending from two sides of the grounding main portion 160 for mounting in the insulative body 11, a front contacting portion 162 extending from the front of the grounding main portion 130 into the front portion 1132 of the receiving space 113, and a rear contacting portion 163 extending from the end of the grounding main portion 160 far away from the insulative body 11. The front contacting portion 162 is used for connecting to the mating connector, and the rear contacting portion 163 is used for mating with the metal shell 15. The front contacting portions 162 of the pair of the grounding members 16 are arranged face to face. The distance between the two front contacting portion 162 in upper and down is longer than the distance between the front mating portion 121 of upper row terminals 12 and the front mating portion 121 of lower row terminals 12.

Referring to FIGS. 4-6, 11, and 12, the adapter board 20 is disposed between the mating member 10 and the cable 30. The cable 30 electrically connects with the mating member 10 through the adapter board 20. The adapter board 20 comprises a front end portion 21 disposed in front, a rear end portion 22 disposed in rear. A plurality of front pads 210 are disposed on an upper and lower surface of the front end portion 21 for connecting with the rear mating portion 122 of the terminals 12. A plurality of rear pads 220 are disposed on the upper and lower surface of the rear end portion 22 for connecting with the core wires 31 of the cable 30. The front end portion 21 of the adapter board 20 is mounted into the insulative member 14 along the mounting groove 1410. The front end portion 21 is disposed between the rear mating portions 122 of the upper row terminals 12 and the lower row terminals 12. The rear mating portions 122 are electrically connected to the corresponding front pads 210.

Referring to FIGS. 2-6, 11, and 12, the internal member 40 encloses the mating rear end 102 of the mating member 10, the adapter board 20, and the front of the cable 30. The internal member 40 comprises a plurality of recessing portions 41 disposed on an outer surface of the internal member 40 and a plurality of recessing slots 42 disposed in front of the recessing portions 41.

Referring to FIGS. 2-6, 11, and 12, when molding the strain relief member 50, the melted plastic filling the recessing portions 41 to form a plurality of projecting portions 51. The strain relief member 50 is bonded with the cable 30 and formed a whole portion with the internal member 40 to increase the force of anti-pullout. The strain relief member 50 comprises a first portion 501 molded outside of the internal member 40 and a second portion 502 molded outside of the cable 30. A radial size of the first portion 501 is larger than the radial size of the second portion 502.

The outer housing 60 is assembled along a front-to-back direction to enclose the internal member 40 and the strain relief member 50. The outer housing 60 is fixed by glue. The receiving slots 42 of the internal member 40 receive the excess glue.

A method of manufacturing a plug connector assembly 1 is disclosed by this invention, comprising the steps of: providing the mating member 10 and soldering the cable 30 to the mating member 10 to complete electrically connection;

molding the internal member 40 to enclose at least a part of the mating member 10 and a part of the cable 30; disposing a plurality of recessing portions 41 on an outer surface of the internal member 40; molding a strain relief member 50 to enclose at least a part of the internal member 40 and a part of the cable 30; disposing a plurality of projecting portions 51 on the strain relief member 50 to fill the recessing portions 41; assembling the outer housing along a front-to-back direction to enclose the internal member 40 and the strain relief member 50; using the glue to fix the outer housing 60; and guiding the excess glue into the receiving slot 42 of the internal member 40.

The strain relief member 50 of this invention is bonded with the cable 30 and formed a whole portion with the internal member 40 to increase the force of anti-pullout and simplify the process of assembling.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing defining a receiving space communicating with an exterior along a front-to-back direction;

a plurality of contacts disposed within the housing with contacting sections exposed within the receiving space;

a metallic shell enclosing said housing;

a printed circuit board located behind the housing with tails the contacts connected upon a front region thereof;

a cable including a plurality of wires with front ends connected to a rear region of the printed circuit board;

an insulative internal member overmolded upon the printed circuit board and enclosing a front portion of the cable; and an insulative strain relief member overmolded upon a rear portion of the internal member and a portion of the cable neighboring said internal member; wherein interlocking means formed on an interface between said strain relief member and said internal member to prevent relative movement therebetween in the front-to-back direction, includes a recess formed in one of said strain relief member and said internal member, and a protrusion formed on the other of said strain relief member and said internal member and filling said recess;

wherein said recess extends along a periphery of said internal member; wherein said protrusion is formed on the strain relief; including an insulative outer housing intimately enclosing a combination of both said internal member and said strain relief except a rear portion of the strain relief; wherein said outer housing is rearwardly assembled upon said combination along said front-to-back direction; wherein at least a receiving slot is formed in an exterior surface of the internal member.

* * * * *